US008240011B2

(12) United States Patent
Chevrolet

(10) Patent No.: US 8,240,011 B2
(45) Date of Patent: Aug. 14, 2012

(54) DEVICE FOR FASTENING INTERCHANGEABLE WATCHSTRAPS WITH SLIDING LOCK MECHANISM

(75) Inventor: Gérard Chevrolet, Damphreux (CH)

(73) Assignee: Paul Hartzband, Chappaqua, NY (US)

( * ) Notice: Subject to any disclaimer, the term of this patent is extended or adjusted under 35 U.S.C. 154(b) by 305 days.

(21) Appl. No.: 12/707,096

(22) Filed: Feb. 17, 2010

(65) Prior Publication Data

US 2011/0197400 A1 Aug. 18, 2011

(51) Int. Cl.
*G04B 37/16* (2006.01)

(52) U.S. Cl. ..... 24/265 B

(58) Field of Classification Search ..... 24/265 B, 24/265 WS; 368/282; 224/164
See application file for complete search history.

(56) References Cited

U.S. PATENT DOCUMENTS 2,827,213 A * 3/1958 Cornu ..... 224/174
3,217,374 A 11/1965 Sang
5,483,505 A * 1/1996 Cartier ..... 368/282
5,914,913 A 6/1999 Shriqui
6,014,793 A * 1/2000 Howald ..... 24/265 B
7,380,979 B2 * 6/2008 Hiranuma et al. ..... 368/282
7,507,018 B2 * 3/2009 Hozumi et al. ..... 368/282
2007/0143970 A1 * 6/2007 Loetscher ..... 24/265 B

FOREIGN PATENT DOCUMENTS

CH 698934 B1 * 12/2009
FR 2766587 A1 * 1/1999
FR 2849355 A1 * 7/2004
WO 03/070044 8/2003

* cited by examiner

*Primary Examiner* — James Brittain
(74) *Attorney, Agent, or Firm* — Young & Thompson

(57) ABSTRACT

A device for fastening interchangeable watchstraps with sliding lock mechanism, in particular for a watchcase, including a middle (1) and two pairs of horns (2), each horn being provided on its inner face with a skid (8) with one bevelled edge and a gap (10). Each watchstrap strand (3) includes a first link (4) on the lateral faces of which are found two grooves (5) adapted to the shape of the skids (8). Each groove contains a pin (6) connected to a head (7) and to a spring. The fastening takes place when the skids (8) engage in the grooves (5) of the first link (4) until locking of the pins (6) in the gaps (10). The watchstrap can be released by acting on the two heads (7) which retract the pins (6) from the gaps (10), making it possible to withdraw the watchstrap strand (3).

9 Claims, 15 Drawing Sheets

DEVICE FOR FASTENING INTERCHANGEABLE WATCHSTRAPS WITH SLIDING LOCK MECHANISM

TECHNICAL FIELD

The present invention concerns a device for fastening interchangeable watchstraps with sliding lock mechanism, in particular for watches and jewelry.

One important element of the external parts of a watch is the watchstrap allowing it to be fastened to the wrist.

The evolution of lifestyles and fashion has created new needs, in particular regarding changing watchstraps, to adapt it to the circumstances, clothing or fashion of the time period.

Quality watches often use conventional means for fastening the watchstrap, i.e. clips or horns with a site for the end of the watchstrap. This watchstrap can be made in leather, metal, or any other material adapted to this use. To ensure reliable fastening of the watchstrap on the watch, they should be made integral with each other. In many watch fastening systems, a cylindrical lug is used, at least one of the two pivots of which is mobile axially. This lug is integral with the watchstrap strand by a through opening, formed in the latter part. The pivots are housed in bores, provided face-to-face in the horns of the watch. Because of this, the watchstrap is integral with the watch, via the lug, on the longitudinal axis and the vertical axis. The longitudinal axis is defines by the axis of the watchstrap, whereas the vertical axis is defined in reference to the thickness of the watch, perpendicularly to the general plane defined by the watch. Blocking on the transverse axis, i.e. the axis of the lug, is ensured, in both directions, by the fastening means of the watch, since the distance between the horns is practically equal to the width of the watchstrap. Ordinarily, the inner faces of the horns, in which the bores are formed intended to receive the pivots of the barrette, are parallel to each other, and generally parallel to the longitudinal axis of the watchstrap.

The watchstrap therefore cannot be changed instantaneously or easily by the wearer of the watch. The wearer must then address the seller, who uses appropriate tools.

The present invention aims to provide a watchstrap fastening device to meet the new needs, in the perspective described above, i.e. to allow the user to change the watchstrap easily, without tools and reliably.

STATE OF THE ART

Many known patents share proposals to resolve the same problem: how to change a watch watchstrap oneself quickly and without tools and still ensure the reliability of the connection?

U.S. Pat. No. 3,217,374 proposes fastening the watchstrap using the usual holes formed in the horns and comprising two pins mounted on sliding sleeves and connected to push pieces, placed in the first link of the watchstrap and kept separated by a spring. Pushing on the push buttons at the same time causes the two sleeves to slide toward the center of the space between the horns, which releases the strand of the watchstrap. One significant drawback of this device resides in the difficulty of putting the watchstrap strand into place since, unlike the invention, there is no guide to bring the pins opposite the bores of the horns. Another major drawback is that there is a risk of an unfortunate motion or pressing actuating one of the push-pieces, which could be enough to release the watchstrap and lose the watch.

Patent application WO 03/070044 also uses push-pieces which are driven into orifices placed on the same axis as the barrette holes. A spring holds the push-piece toward the outside of the horn, thus freeing part of the barrette hole. The watchstrap strand is provided with a retractable barrette at both ends and its placement is traditional. To remove the watchstrap strand, it is necessary to push on the two push-pieces at the same time, which causes the pins to go into the barrette, freeing the watchstrap. The drawbacks noted in the aforementioned patent are applicable here as well.

U.S. Pat. No. 5,914,913 aims to resolve the same problem. In this case, the slides are replaced by a type of screwed crowns, each provided with a pin at their end. The first link of the watchstrap comprises an orifice in which the pins are embedded when the crowns have been tightened. Here again we must note the absence of guide during placement of the watchstrap strands.

DISCLOSURE OF THE INVENTION

The present invention aims to realize interchangeable watchstrap fastening via a sliding lock mechanism made up of a groove formed on each side of the first link of the watchstrap strand, groove in which a pin is found attached to a head placed on the lower face of the link and kept separated by a spring. A skid, provided with one beveled edge, is placed on each horn. This skid comprises a recess designed to receive the corresponding pin. The fastening is done by directing the watchstrap strand toward the space between the horns. The skids, with their beveled ends, engage in the grooves of the first link and force the pins to go into their housing until they are opposite the countersunk recess in the skids where they can assume their place, pushed by the spring. In order to release the watchstrap strand, it is necessary to grasp a control organ in order to separate the pins from the passage arranged in the skids, making it possible to pull on the watchstrap strand in order to release it from the space between the horns.

Through this new design, the watchstrap is integral with the watch on its three axes. Its fastening is thus ensured and is reliable.

BRIEF DESCRIPTION OF THE DRAWINGS

The embodiments of the invention, in no way limiting, are now described using the following drawings.

DETAILED DESCRIPTION

Figure 1:
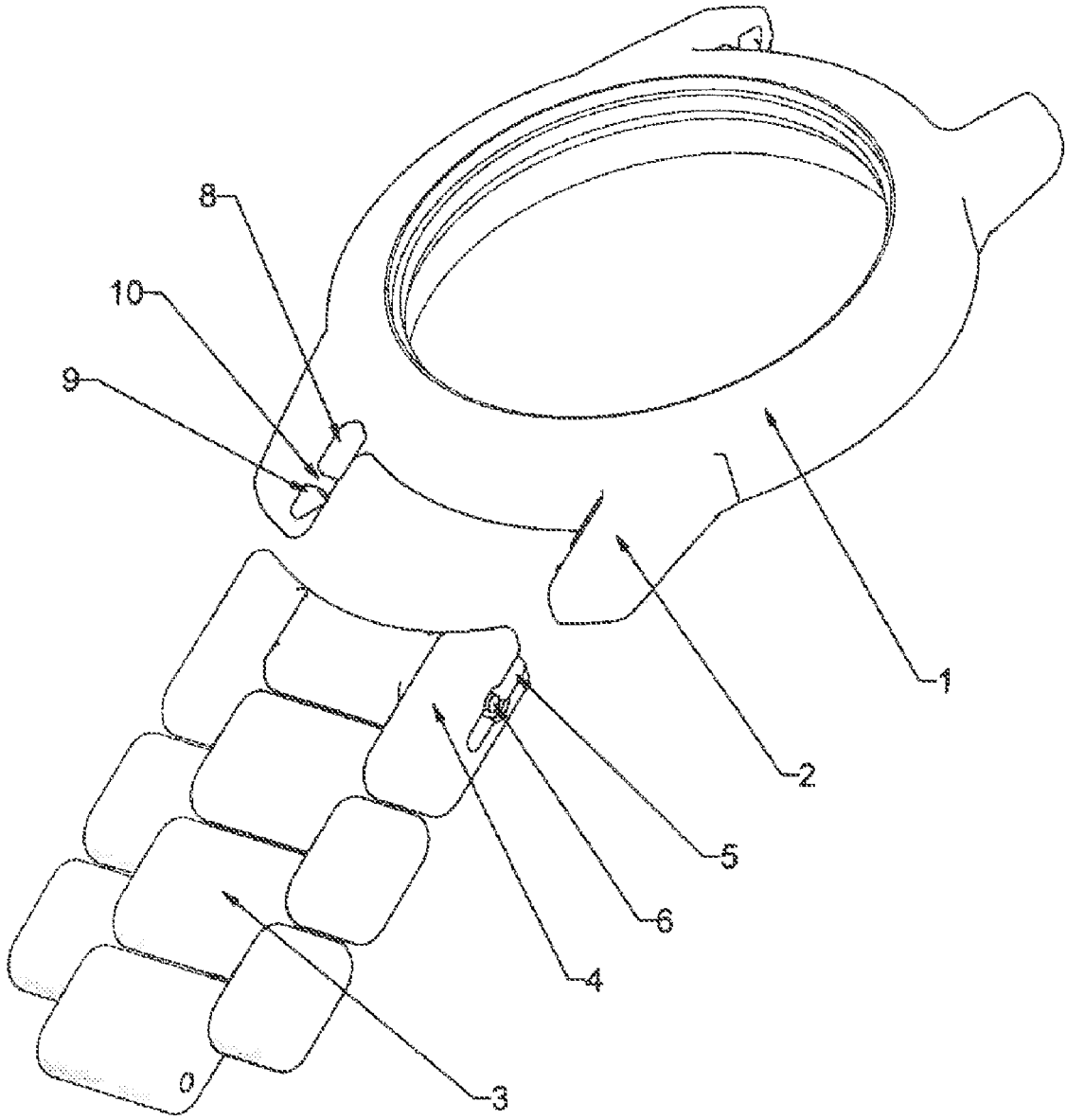
FIG. 1 represent a watchcase with watchstrap separated, according to the invention, seen from above.

FIG. 1 illustrates a watchcase with the watchstrap according to the invention, seen from above. One shows a middle 1 comprising four horns 2 to cooperate with a watchstrap, a strand 3 of which only being illustrated. This watchstrap strand 3 defines a longitudinal axis. Horns 2 are opposite each other in pairs with inner faces parallel to the longitudinal axis of the watchstrap. The watchstrap strand 3 comprises a first link 4 in which grooves 5 have been made on the lateral faces. A pin 6 is placed in each groove 5. These pins 6 are mounted mobile in reference to the first link 4 and are able to be retracted, at least partially, inside the first link 4. Pins 6 are kept spread by a spring not visible in FIG. 1.

The inner faces of the horns 2 are provided with skids 8 with one beveled end 9. The skids 8 are arranged in order to cooperate with the grooves 5 and to slide within. Skids 8 and grooves 5 define together guiding means, which facilitate the assembly of the watchstrap strands 3 on the middle 1, as well as the reverse operation.

Each skid 6 further comprises a recess 10 which at least partially interrupts the wall of the skid. The dimensions of the recess are adapted to lodge a pin 6 when the watchstrap strand 3 is locked on the middle 1. Pins 6 and corresponding recesses 10 form locking means for fastening a watchstrap strand 3 on the middle 1.

Each pin 6 is therefore able to switch between:

- a first state wherein the spring is compressed and the pin 6 is retracted at least partially inside the first link 4 so that it does not cooperate with the recess 10, and
- a second state wherein the pin 6 is lodged within the recess 10 by the action of the spring, operating the locking of the watchstrap on the middle 1.

Figure 2:
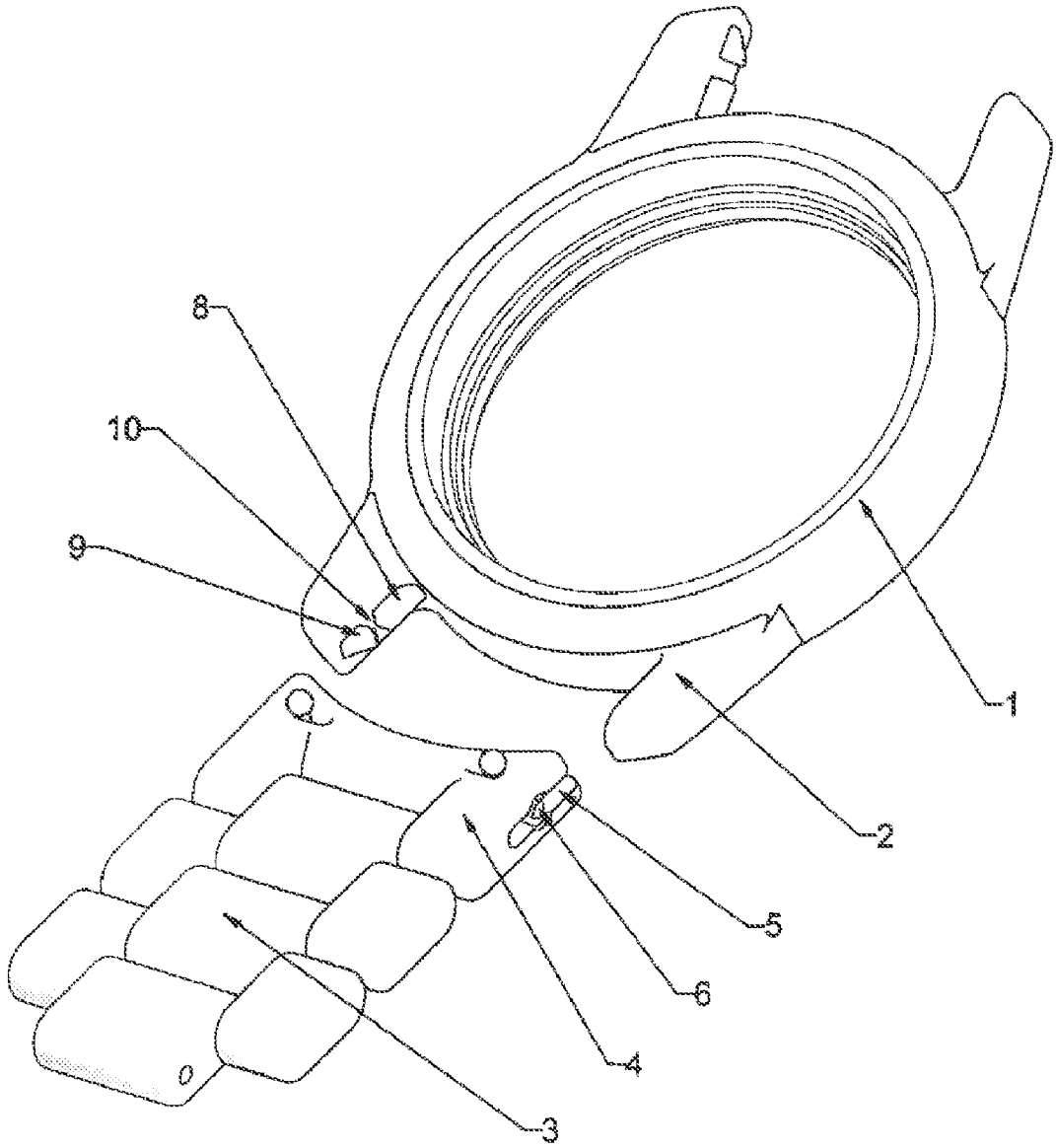
FIG. 2 shows a watchcase with watchstrap separated, according to the invention, seen from below.
Figure 3:
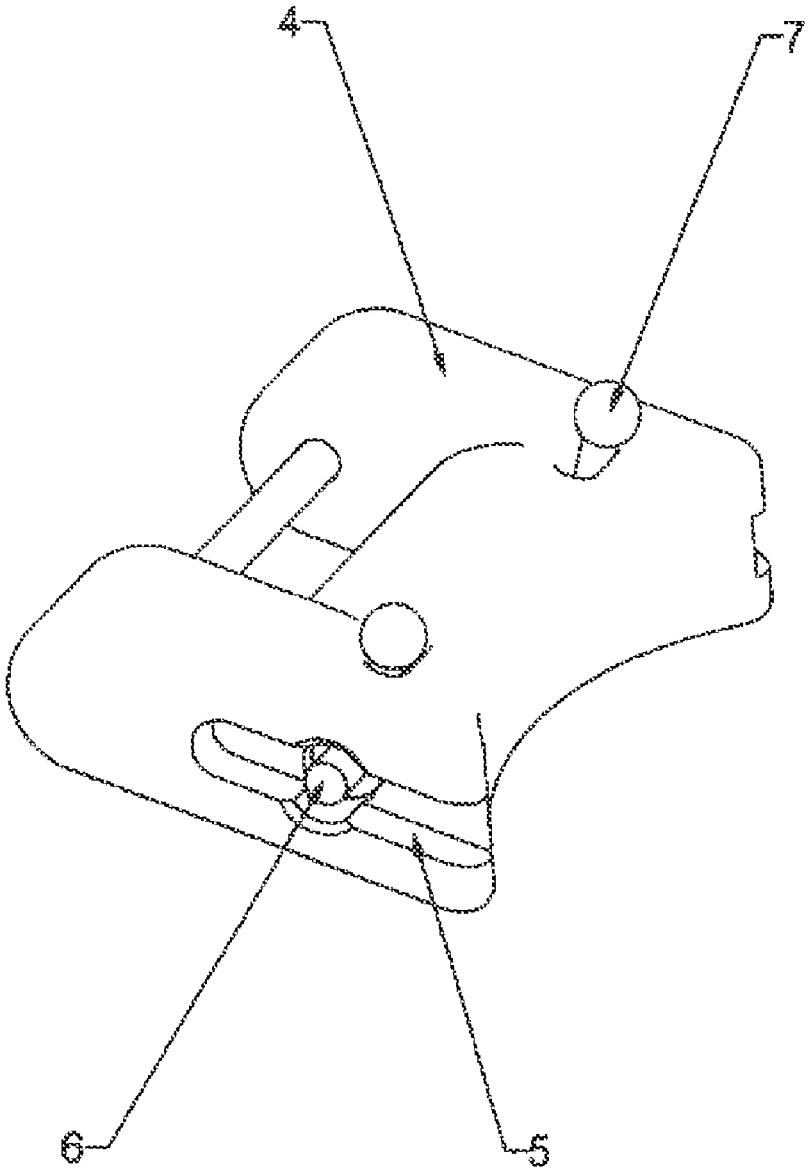
FIG. 3 shows a bottom view of the first link of the watchstrap strand.

FIG. 2 is a bottom view of the same watchcase, with separated watchstrap. We see the same elements as in the preceding figure. One can also remark a control organ connected to the pins 6. In this example, the control organ takes the form of two heads 7, integral with the pins 6 and illustrated in details on FIG. 3. This latter shows the first link 4, a groove 5, a pin 6 and the two heads 7, each one being integral with a pin 6.

Figure 4:
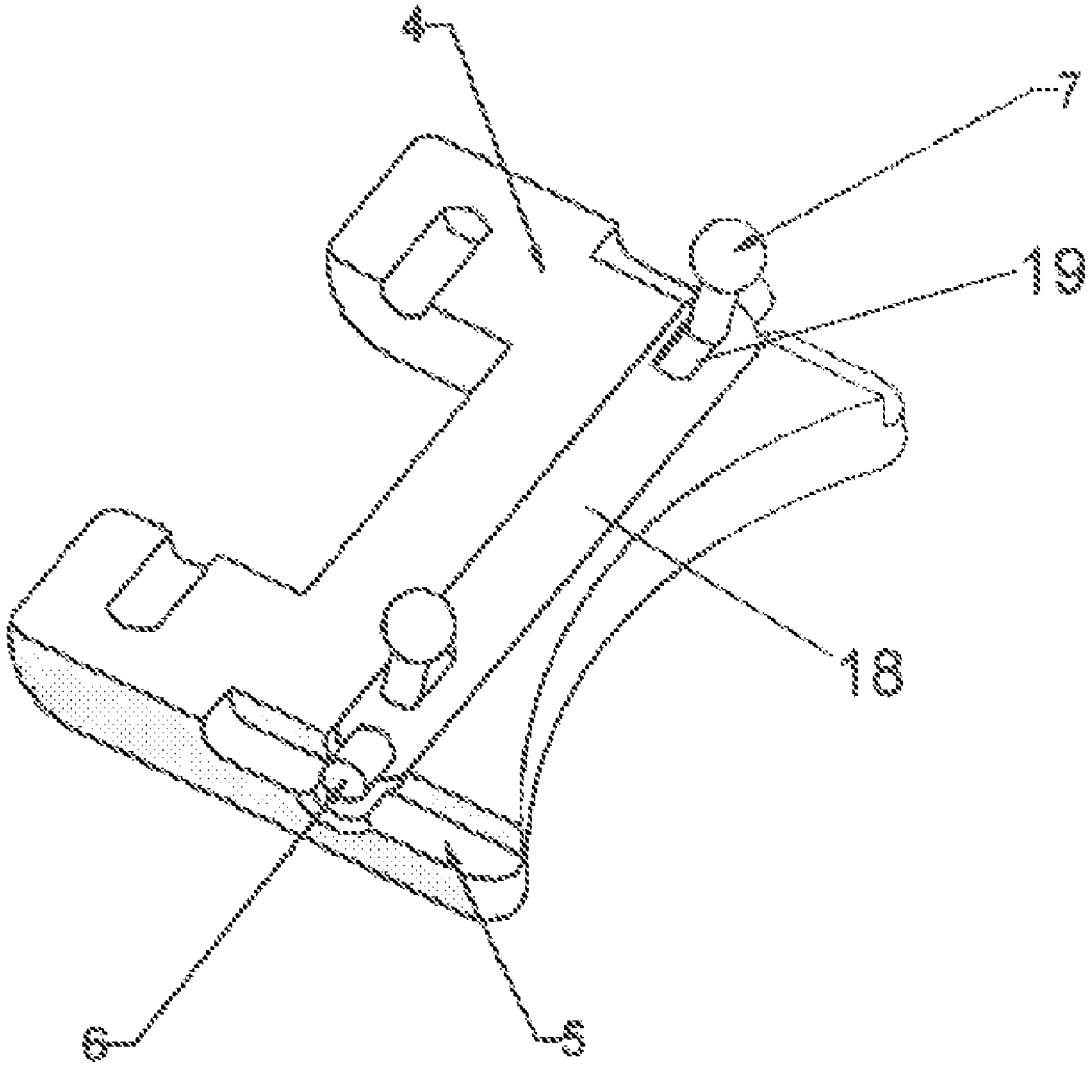
FIG. 4 shows a cutaway view of the first link of the watchstrap strand.

As shown on FIG. 4, pins 6 are mounted mobile inside a tube 18, integral with the first link 4. The spring above mentioned is fitted inside the tube 18 and leads and maintains the pins 6 in their second state. The wall of the tube 18 presents windows 19 to allow the actuation of the control organ and the displacement of the heads 7 towards each other.

Figure 5:
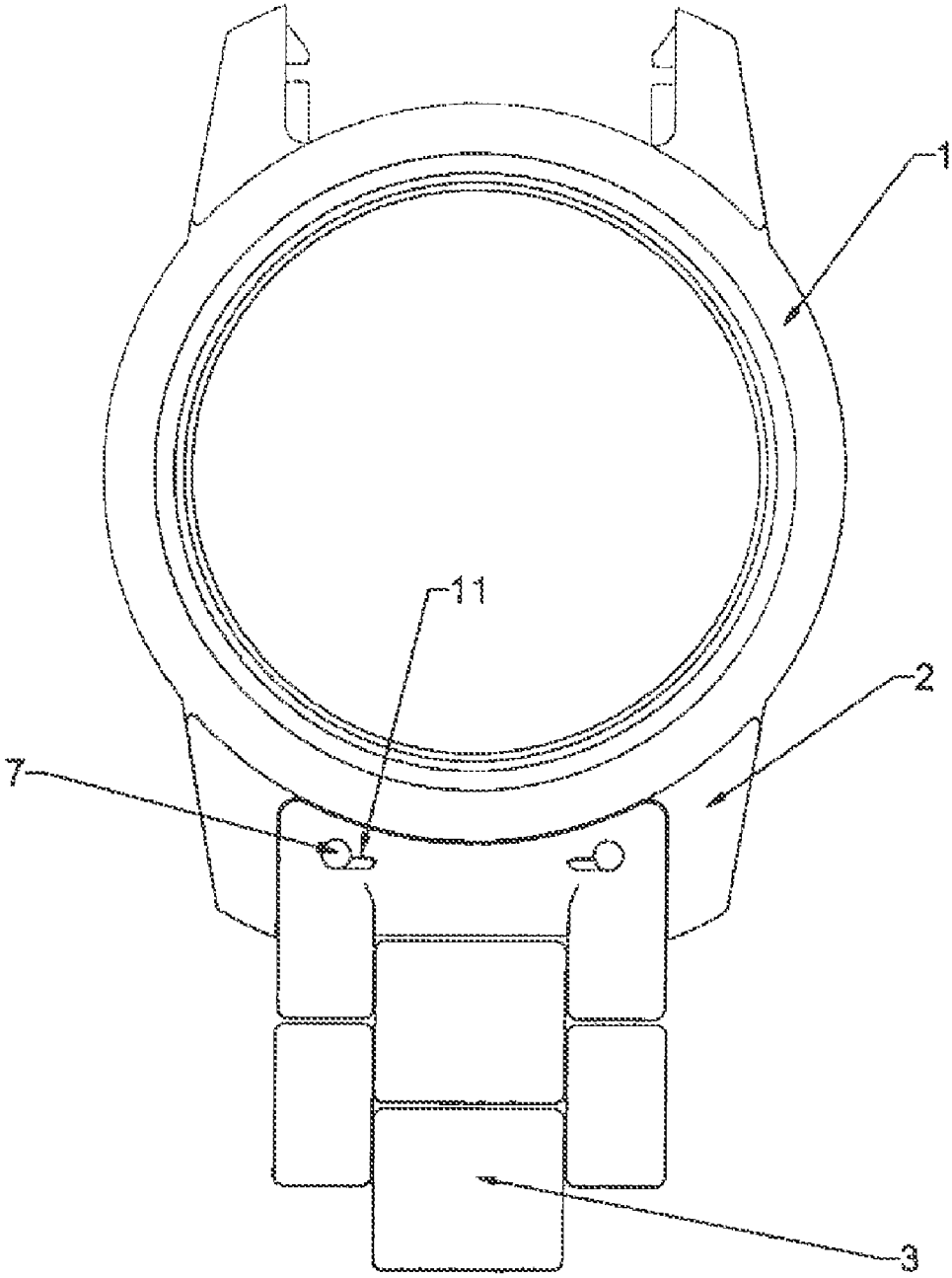
FIG. 5 shows a bottom view of an embodiment with the watchstrap strand fastened.
Figure 6:
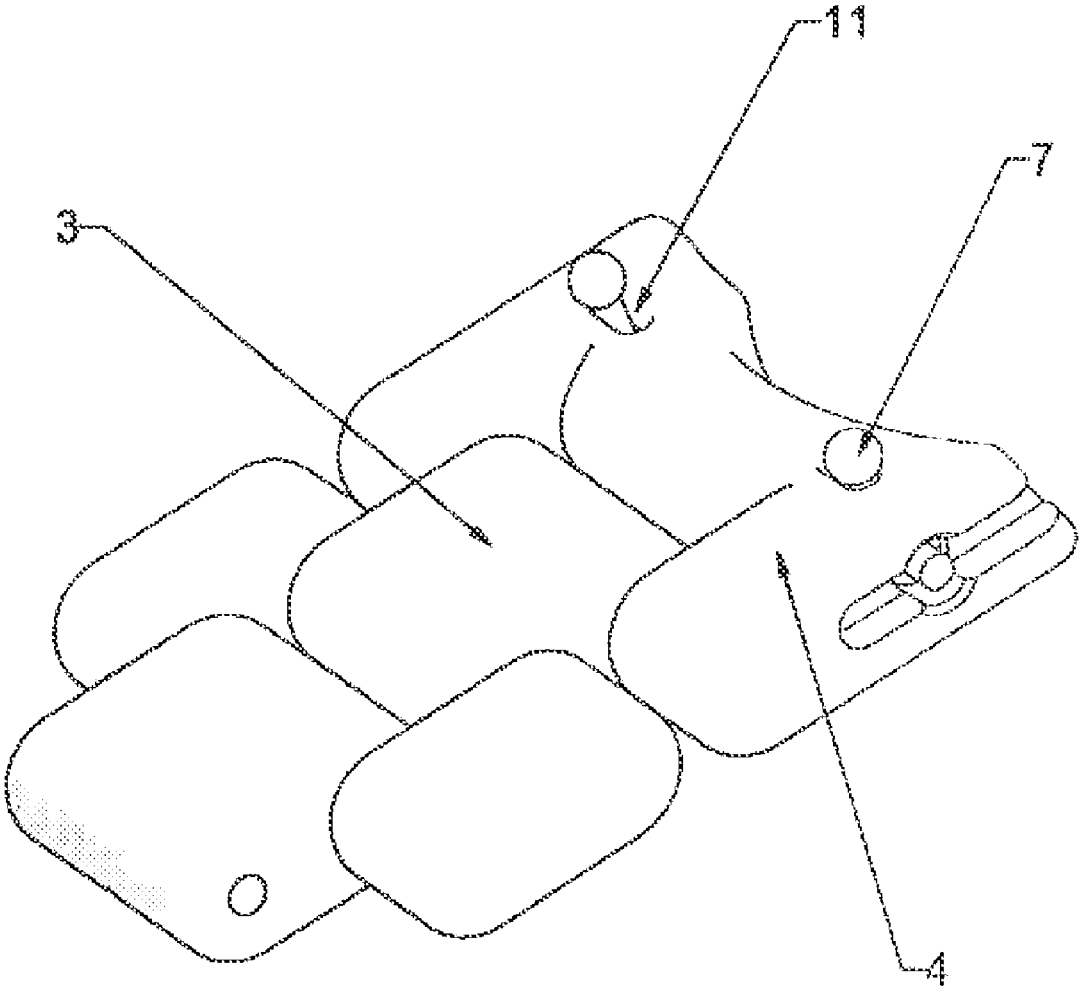
FIG. 6 shows a perspective view of a part of a strand of the watchstrap according to the invention.
Figure 7:
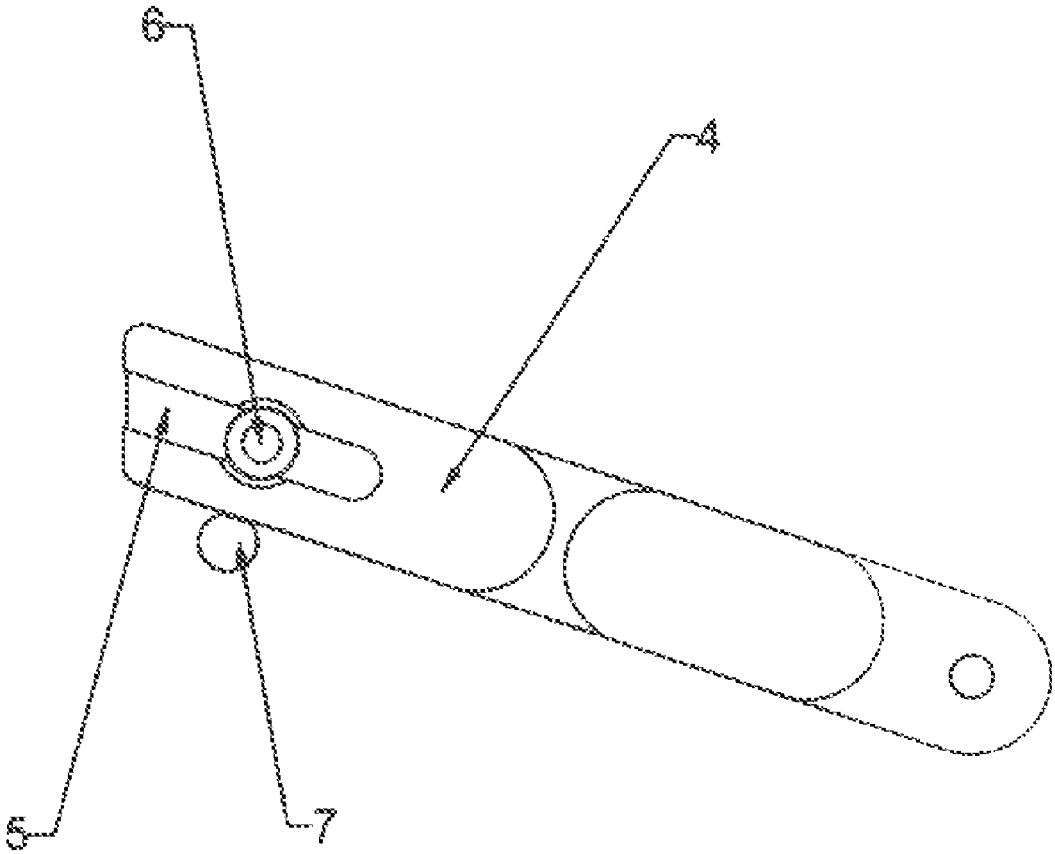
FIG. 7 is a side view of a part of a strand of the watchstrap according to the invention.

FIG. 5 is a bottom view of an embodiment of the invention, with the watchstrap fastened to the watchcase. Two longitudinal openings 11 are also arranged in the link 4, to allow the displacement of the heads 7 toward the center of the space between the horns 2.

Thus, if a user wants to fasten a watchstrap strand 3 to a watchcase according to the invention, he has simply to engage the skids 6 inside the grooves 5, the cooperation of which operates a perfect guiding of these pieces. The pins 6 are therefore only under the influence of the springs and are in a position called "out", corresponding approximately to their second state. When the pins 6 arrive in contact with the beveled ends 9 of the skids 8, they retract progressively inside the link 4, by the action of the user who engages further the skids 8 in the grooves 5. Simultaneously, the spring becomes compressed. When the pins 6 arrive at the level of the recess 10, they automatically penetrate in the recess 8, under the action of the release of the spring, and become into their second state. The watchstrap strand 3 is therefore fastened to the watchcase middle 1. Thanks to the guiding means, both pins 6 of a strand fasten almost simultaneously, with no risk of being slanted or put out of true. To disengage the watchstrap from the watchcase, the user actuates the control organ by tightening one head 7 against the other. This action leads to get the pins 6 closer to each other and to bring them back to their first state. When the pins 6 are not engaged in the recesses 10 any more, the user can simply move away the strand from the watchcase, this displacement being still guided by the sliding of the skids 6 in the grooves 5, until complete release of them.

Figure 8:
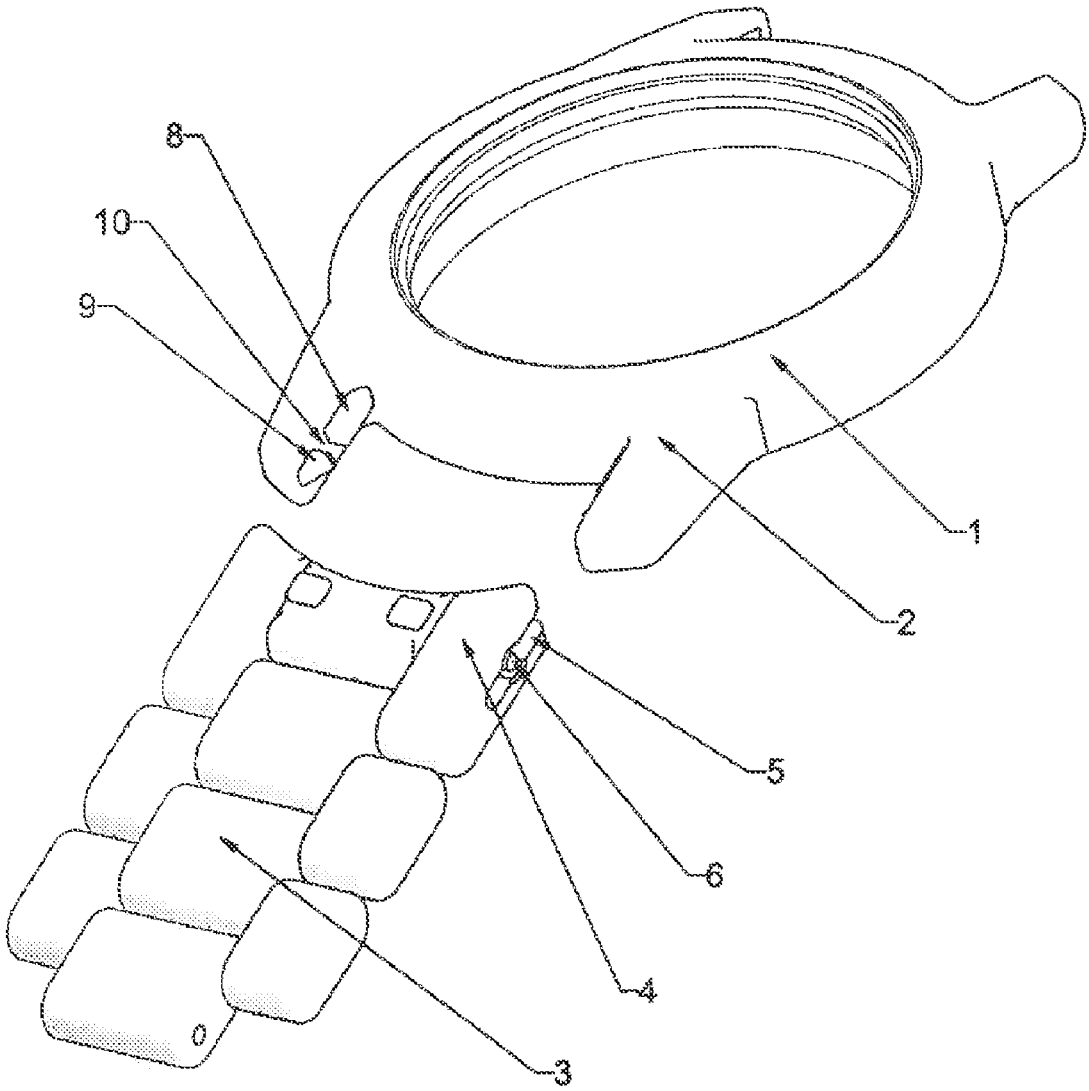
FIG. 8 is a perspective view of a variant of the invention.
Figure 9:
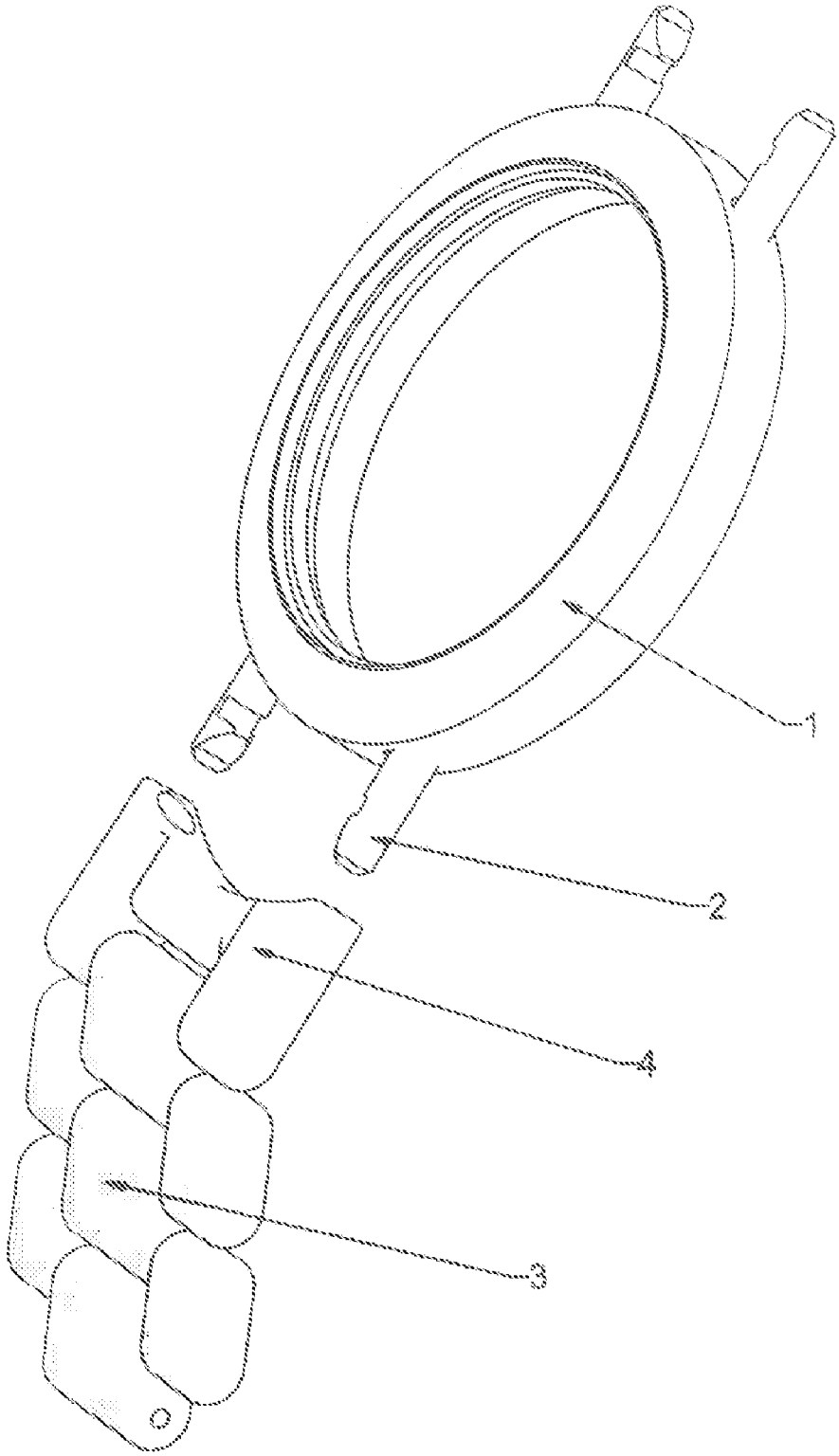
FIGS. 9 and 10 show the upper side and the under side of a second embodiment of the invention, with the case and the watch strap separated.
Figure 10:
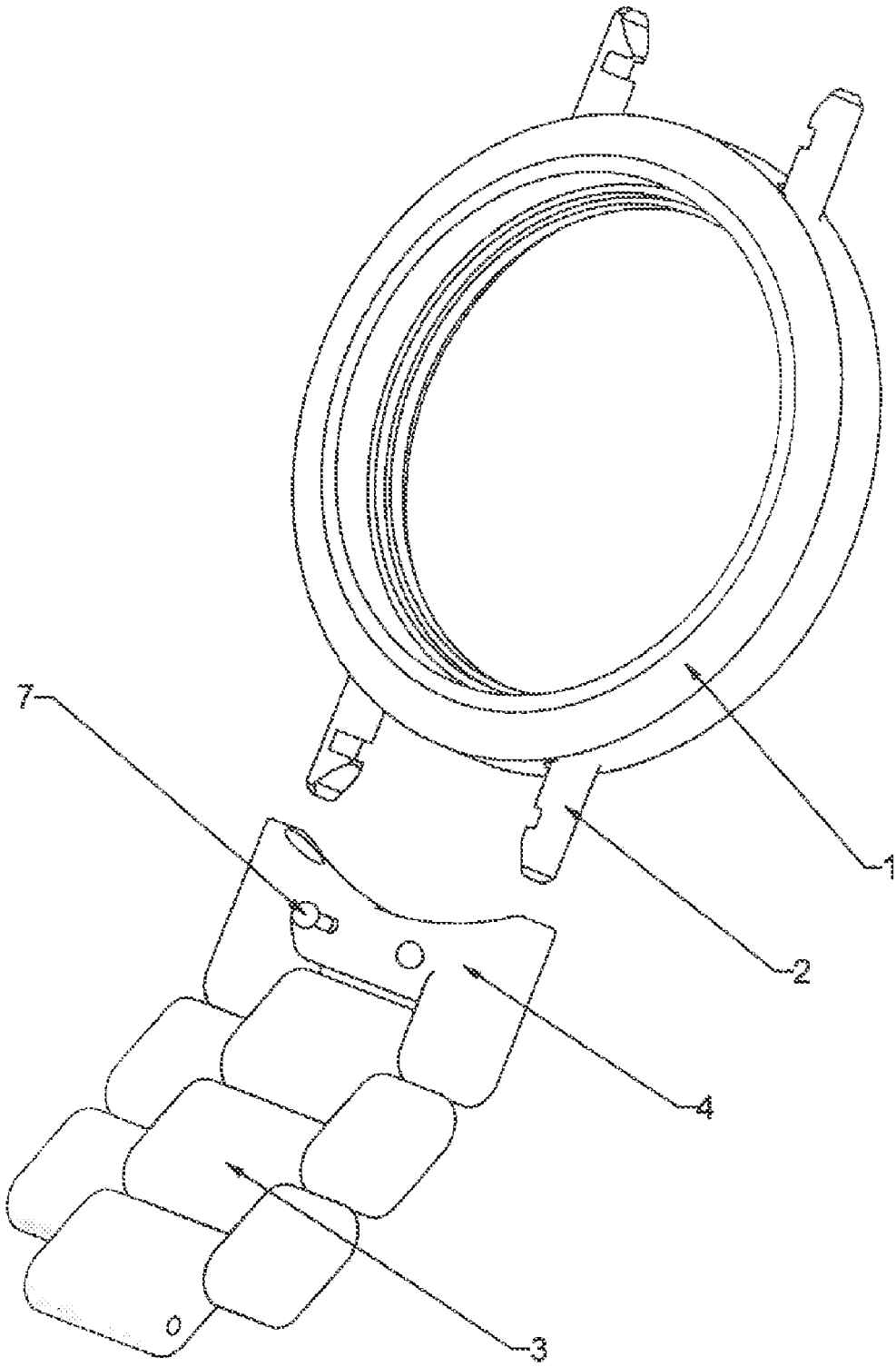
Figure 11:
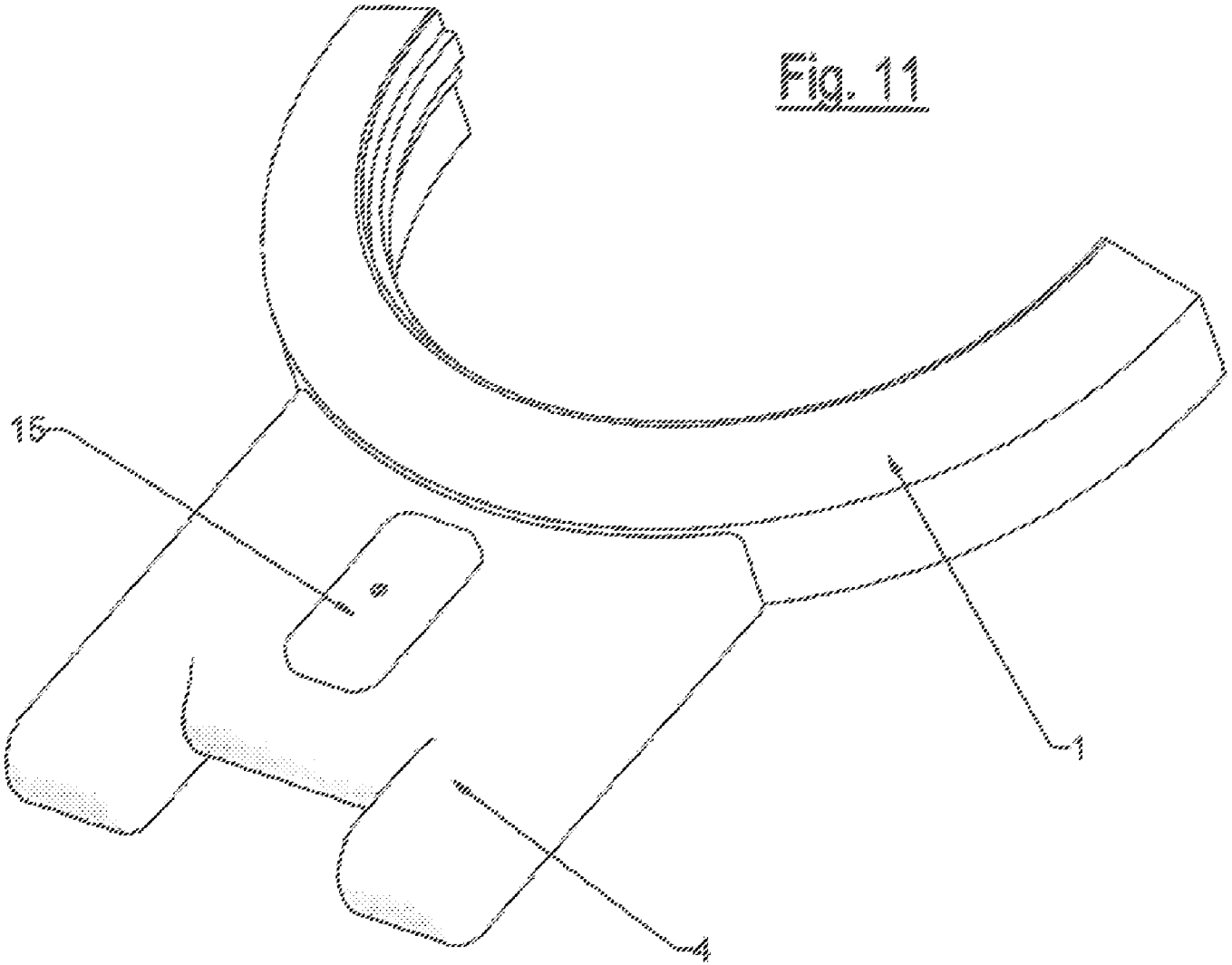
FIGS. 11-13 represent a variant of the control organ, with the watchstrap locked to the case, or not, and with cutaway views for FIGS. 12 and 13.

FIG. 8 shows another embodiment of the invention. The control organ is arranged on the top of the first link 4. This figure also illustrates another shape for the control organ. It is constituted by small blocks arranged slidable on the surface of the link. One can also consider these blocks being able to be pushed inside the link to actuate the pins 6. A skilled person knows how to implement such arrangements without describing it with more details.

In FIGS. 9-13, the grooves 5 arranged in the first link 4 are not disposed on the lateral faces of said link 4, but inside it, parallel to the longitudinal axis of the watchstrap. The dimensions of the grooves 5 and of the horns 2 are such that horns 2 can slide inside the grooves 5 with almost no idle. Especially in this embodiment, a horn 2 and a skid 8 can be implemented in a single piece. The pin 6 is mounted mobile in reference to the groove so that it keeps free the groove 5 or so that it takes place in the groove to cooperate with the recess 10. The working of this embodiment is similar to the one described above.

Figure 12:
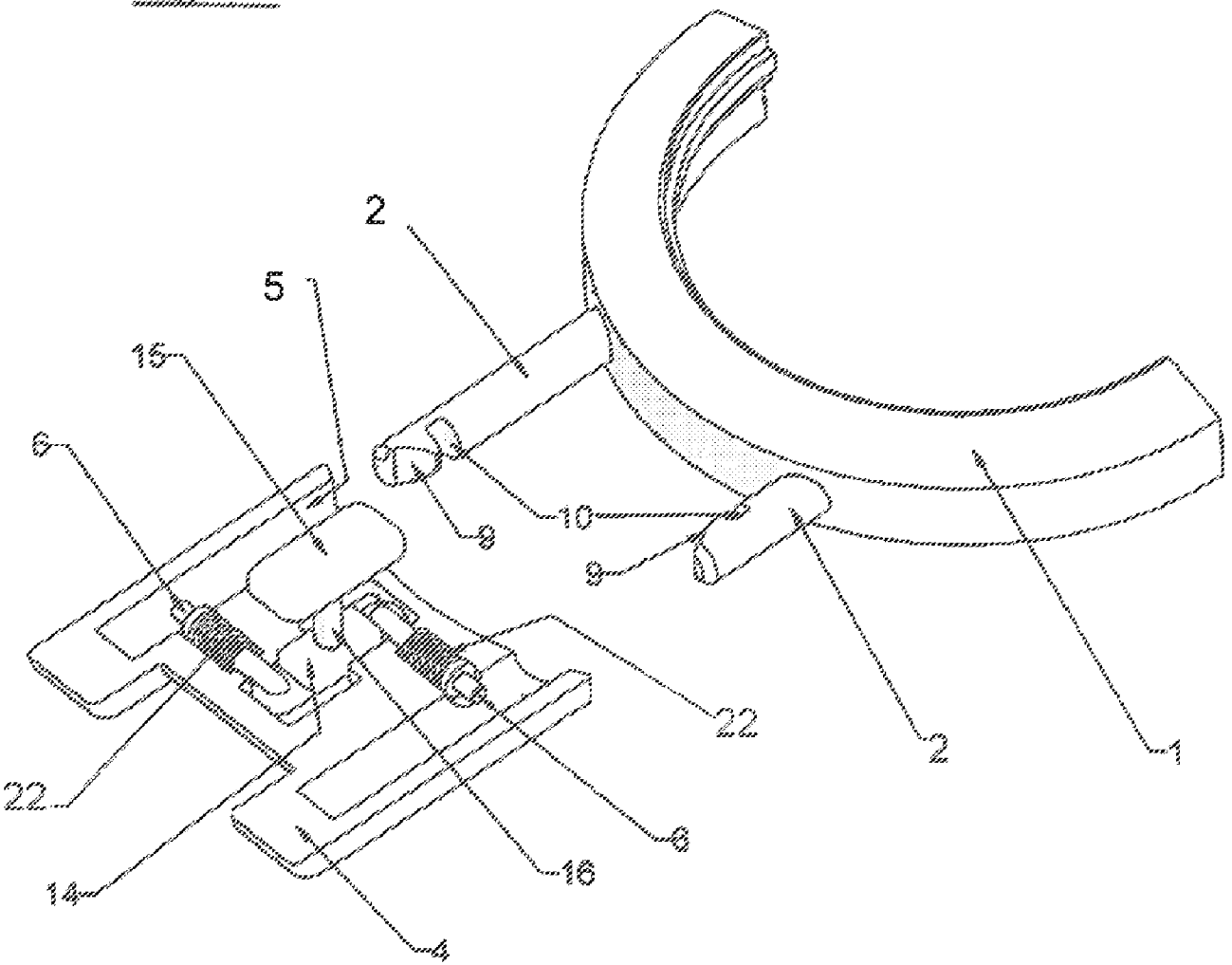
Figure 13:
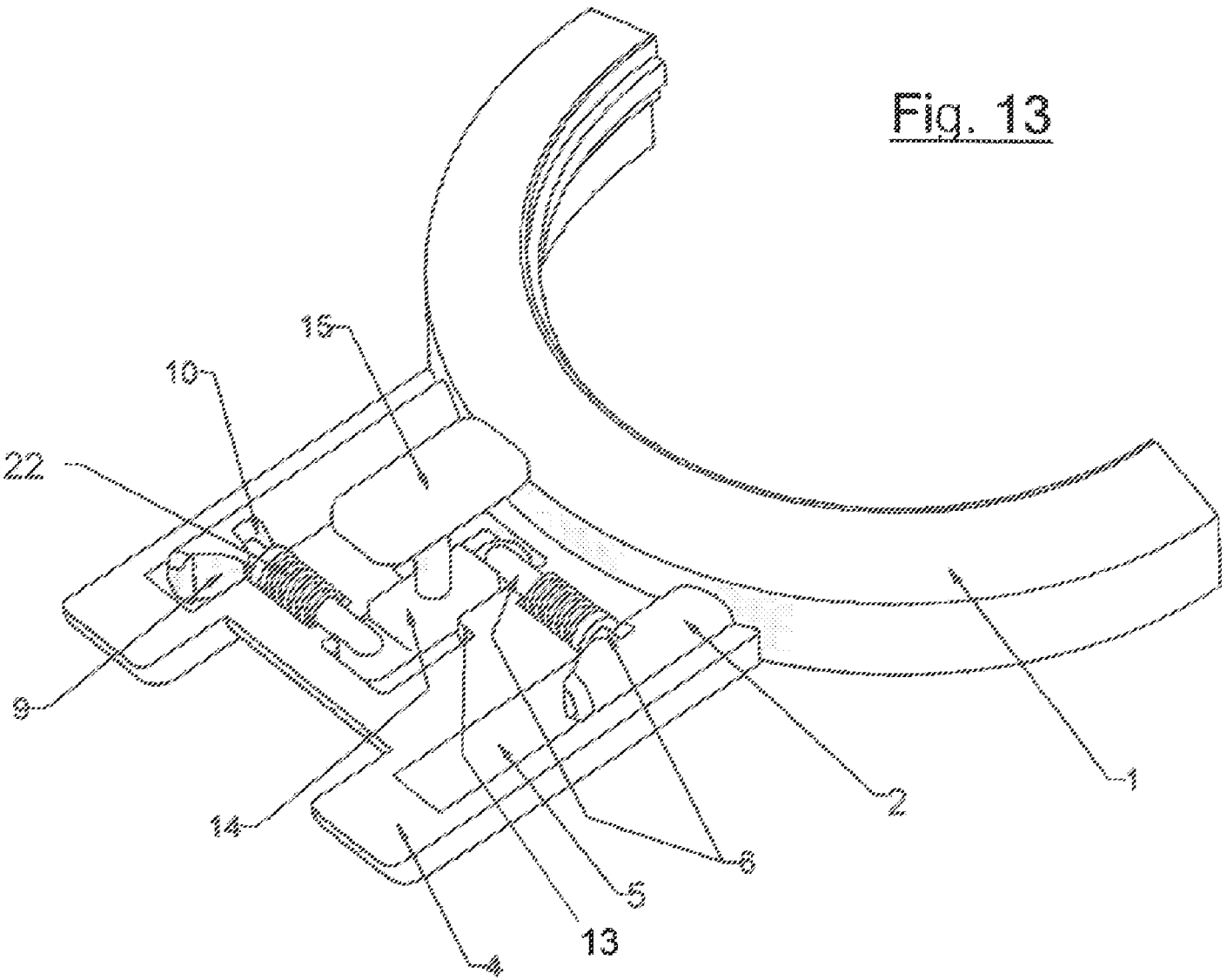

FIGS. 12 and 13 represent another solution for implementing the control organ. Such a solution is shown in connexion with the second embodiment explained in the previous paragraph but it could also be applied with the first embodiment illustrated in FIGS. 1 to 7. This control organ comprises a button 15 mounted rotatable at the surface of the first link 4 according to an axis perpendicular to the general plane defined by the link 4. The button 15 is connected to a rocker 14 through a shaft 15. The rocker 14 cooperates with two pins 6, one at each end of the rocker 14, so that the rocker actuates symmetrically each pin 6. Said pins 6 are mounted mobiles in the first link 4 similarly to the pins described previously so that it keeps free the groove or so that it takes place in the groove to cooperate with the recess. Of course, the pins 6 are not aligned but are disposed parallel. Each pin 6 is pushed by a spring 22. As a consequence, the recesses 10 of the horns 2 of a pair are neither disposed face-to-face but are shifted. Especially with this second embodiment, where the horns 2 can be engaged inside the first link 4, the horns of a pair can present different length, according to the position of the recesses 10.

In order to bring the pins 6 to their first state, the user rotates the button 15, that will involve the rotation of the rocker 14. Some securing means may be arranged so that the button can be rotated only in a direction. For example, some bankings 13 are arrange inside the first link 4. The button 15 can therefore only be actuated so that the pins 6 are retracted. The position of the button 15 is set so that, at rest, i.e. when the watchstrap is locked on the middle 1 of the case or when the watchstrap is separated from the case, the button is disposed in an aesthetic manner in reference to the strap, for example, parallel to the longitudinal axis.

Figure 14:
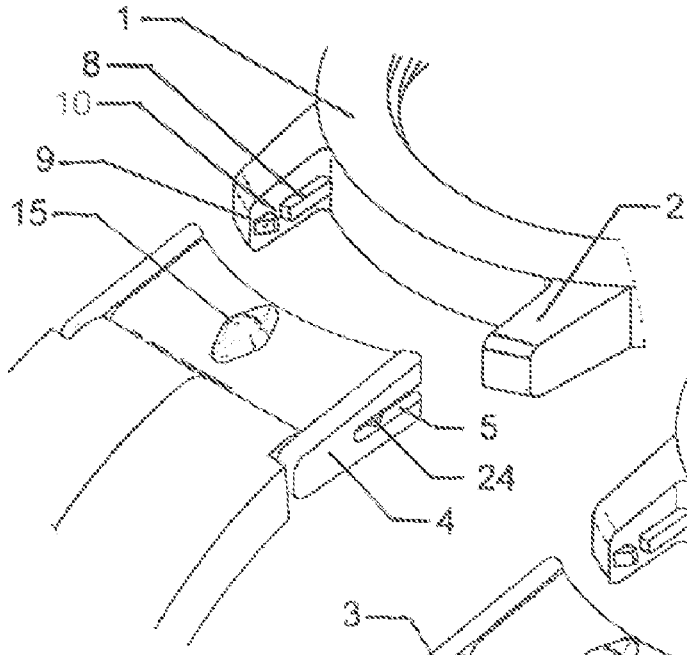
FIGS. 14 to 16 represent another variant of the organ control, with two types of watchstrap on FIGS. 14 and 15 separated from the watchcase, locked to the watchcase for FIG. 16.
Figure 15:
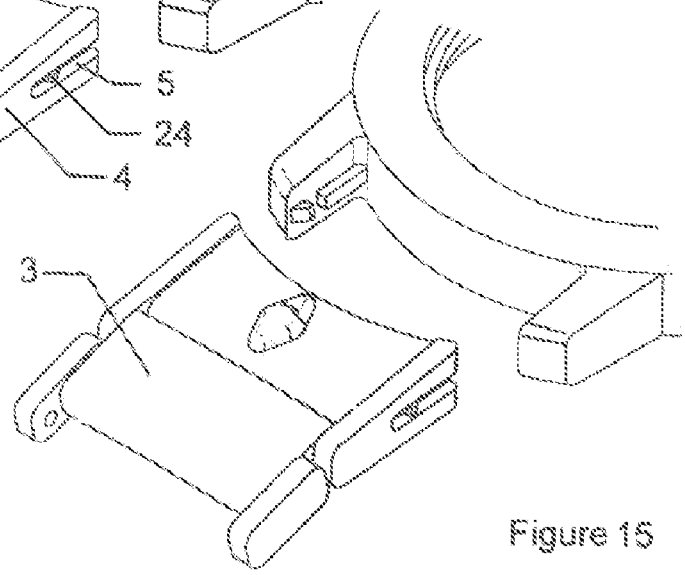
Figure 16:
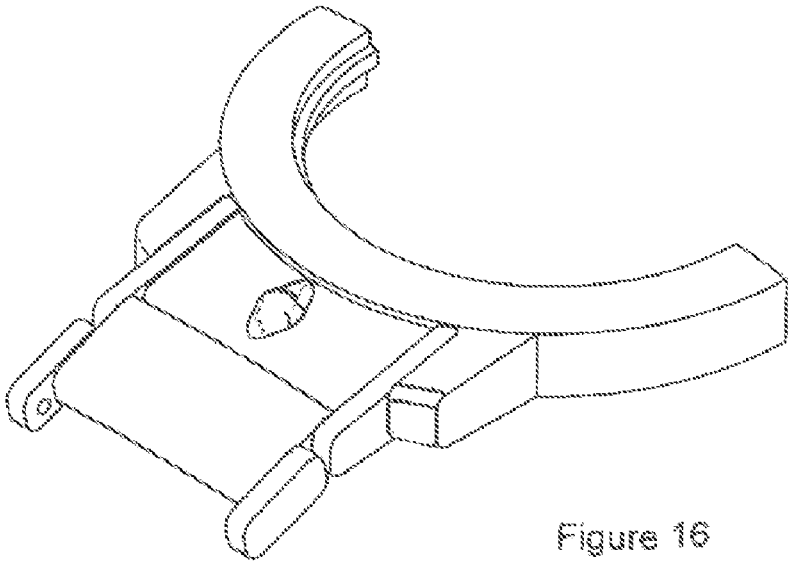
Figure 17:
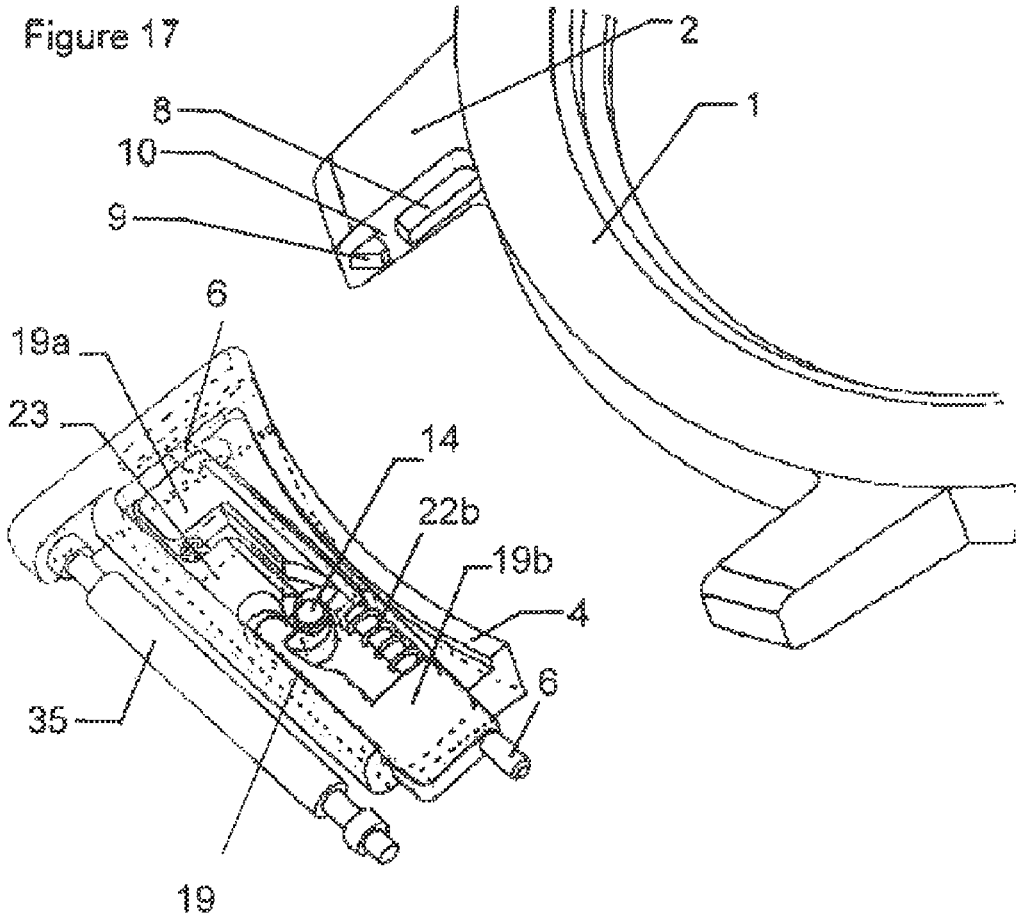
FIGS. 17 and 18 are cutaway views of a variant of the first link of a watchstrap according to the invention, respectively separated from or locked to the watchcase.
Figure 18:
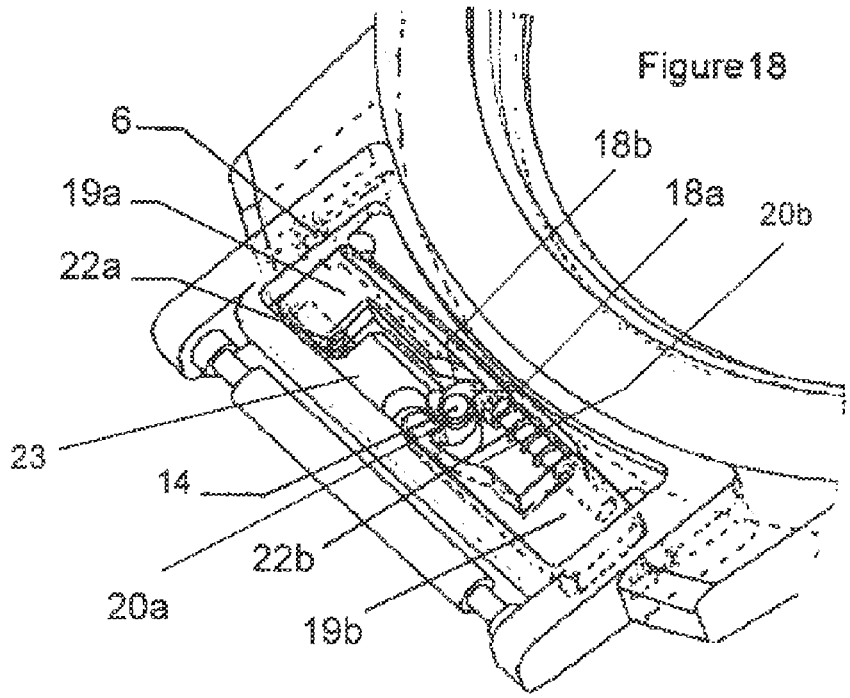

FIGS. 14 to 18 show a variant of the precedent control organ which can also be applied to both previous embodiments of the grooves 5. Like previously, the control organ is mounted rotating in reference to the first link 4. FIG. 14 illustrates how such a first link 4 can be combined with a watchstrap made of leather or rubber, while FIG. 15 illustrates a watchstrap with links. In both cases, the first link comprises a lug 35 which is inserted between a pair of extensions of the first link 4. To this lug can be attached a strap or a second link, as known by a skilled person.

The rocker 14 presents a double cam shape, each cam defining an active face 18*a* and a circular face 18*b*. Each pin 6 is mounted integral with a sliding element 19, able to slide transversally inside the first link 4 so that the pin 6 can move between its first and second states. Each sliding element 19 comprises, on the opposite of the cam of the rocker, a recessed part 20 which defines a straight side 20*a* arrange to cooperate with the active face 18*a* of the cam, and a concave side 20*b*, arranged so that the circular face can move in front of it without any contact. Thus, the button 15 can be actuated in both directions. In a first one, it will pull in the sliding element 19 and the pin 6 and, in a second one, it will have no effect.

To maintain the pins 6 in their second state, one spring is arranged to push on each sliding element. More precisely, for one of the sliding element 19*a*, the spring 22*a* is arranged between the sliding element 19*a* and a support element 23 arranged in a fixed manner inside the first link 4. The spring 22*a* can be guided on a shaft integral with the sliding element 19*a* or with the support element 23 and able to be engaged into an opening arranged, respectively, in the support element 23 or in the sliding element 19*a*. For the other sliding element 19*b*, another solution is proposed, which requires less place. The spring 22*b* is interposed between both sliding elements 19*a* and 19*b*, one replacing the support element i.e. the sliding element 19*a* located in direction of the cam. The guiding shaft is integral with this sliding element 19*a* used as a support. The guiding shaft can be engaged into an opening arranged in the other sliding element 19*b*. The spring 22*b* advantageously pushes both sliding pieces into their second state. Moreover, such a configuration is very optimal for size of the device.

It can be added that the surfaces of the elements, which are intended to glide on each other, i.e. beveled ends, ergots . . . can be coated with a lubricant or with a low friction factor material.

The embodiments described above are in no way limiting and the application of the invention is not restricted to horology. It can also be used in jewelry or for other fasteners in various applications.

What is claimed is:

1. A device for fastening a watchstrap to a watchcase comprising a middle, two pairs of horns, arranged two by two on two sides of the middle, and a watchstrap comprising two strands, each strand comprising a first link intended to adjoin the watchcase, wherein each horn is provided on its lateral face with a skid with one beveled end and a recess, and wherein each first link comprises two grooves arranged so that the skids glide in the grooves, said skids and said grooves defining guiding means of the watchstrap in reference to the watchcase, and wherein each of said grooves comprises a mobile pin connected to a control organ accessible from the outside of the first link, said pin being sized in such a manner that said pin can engage inside one of the recesses and is pushed by a spring which tends to engage the pin in the corresponding recess, and wherein said pin is able to move between a first state wherein the spring is compressed and the pin is retracted at least partially inside the first link so that said pin does not cooperate with the recess, and a second state wherein the pin is lodged within the recess by the action of the spring, operating a locking of the watchstrap on the middle, and wherein said pins are brought in said first state by the contact between each pin on the beveled end of one of the skids when the skids are engaged in the grooves, and the pins move from the second state to the first state during the disengagement of the skids from the grooves, only by the actuation of the control organ.

2. The device of claim 1, wherein said grooves are provided on the lateral faces of said first link (4).

3. The device of claim 1, wherein said grooves (5) are provided completely inside said first link (4) and present an opening on the side of said first link intended to adjoin the watchcase.

4. The device of claim 1, wherein the control organ comprises a pair of heads (7) able to glide transversally in said first link (4).

5. The device of claim 1, wherein the control organ comprises a button (15) able to rotate onto said first link.

6. The device of claim 5, wherein said button (15) is arranged in order to actuate the pins when it is rotated in a first direction and in order to have no effect on the pins when it is rotated in a second direction.

7. The device of claim 6, wherein said button (15) is integral with a rocker (14) provided with a double cam shape, each cam defining an active face (18*a*) and a circular face (18*b*), and in that each pin (6) is integral with a sliding element (19), able to slide transversally inside the first link (4) so that the pin (6) can move between its first and second states, and in that each sliding element (19) comprises, on the opposite of the cam of the rocker (14), a recessed part (20) which defines a straight side (20*a*) arrange to cooperate with the active face (18*a*) of the cam, and a concave side (20*b*), arranged so that the circular face (18*b*) of the cam can move in front of it without any contact.

8. The device according to claim 1, wherein the control organ is accessible from the upper side of the first link (4).

9. The device according to claim 1, wherein the control organ is accessible from the underside of the first link (4).

* * * * *